US009181065B2

(12) United States Patent
Schumacher et al.

(10) Patent No.: US 9,181,065 B2
(45) Date of Patent: Nov. 10, 2015

(54) DRIVE REGULATING DEVICE ARRANGED AT ELEVATOR CAR DOOR LINTEL

(75) Inventors: Erich Schumacher, Sarnen (CH); Hansueli Stocker, Immensee (CH); Jules Christen, Altdorf (CH); Nicolas Gremaud, Richterswil (CH)

(73) Assignee: Inventio AG, Hergiswil (CH)

( * ) Notice: Subject to any disclaimer, the term of this patent is extended or adjusted under 35 U.S.C. 154(b) by 933 days.

(21) Appl. No.: 13/386,534

(22) PCT Filed: Jul. 6, 2010

(86) PCT No.: PCT/EP2010/059663
§ 371 (c)(1),
(2), (4) Date: Apr. 5, 2012

(87) PCT Pub. No.: WO2011/009715
PCT Pub. Date: Jan. 27, 2011

(65) Prior Publication Data

US 2012/0186915 A1 Jul. 26, 2012

(30) Foreign Application Priority Data

Jul. 23, 2009 (EP) ..... 09166230

(51) Int. Cl.
*B66B 13/14* (2006.01)
*B66B 5/00* (2006.01)

(52) U.S. Cl.
CPC ..... *B66B 13/143* (2013.01); *B66B 5/0087* (2013.01)

(58) Field of Classification Search
CPC .. B66B 1/3423; B66B 5/0025; B66B 5/0062; B66B 11/0025; B66B 13/143; B66B 5/0087; B66B 11/005
USPC ..... 187/247, 316, 391, 393, 394
See application file for complete search history.

(56) References Cited

U.S. PATENT DOCUMENTS

| | | | | |
|---|---|---|---|---|
| 4,004,655 | A * | 1/1977 | Kraft et al. | 187/324 |
| 4,149,615 | A * | 4/1979 | Kappenhagen | 187/324 |
| 4,685,537 | A * | 8/1987 | Kappenhagen | 187/316 |
| 5,918,705 | A * | 7/1999 | Friend | 187/335 |
| 6,006,866 | A * | 12/1999 | Horne et al. | 187/316 |
| 7,281,609 | B2 * | 10/2007 | Del Rio Sanz et al. | 187/316 |
| 7,503,434 | B2 * | 3/2009 | Grundmann | 187/316 |
| 7,546,903 | B2 * | 6/2009 | Kattainen et al. | 187/316 |
| 7,568,557 | B2 * | 8/2009 | Rossignol | 187/401 |
| 2008/0047784 | A1 * | 2/2008 | Krause et al. | 187/316 |
| 2008/0236955 | A1 * | 10/2008 | Kattainen et al. | 187/316 |

(Continued)

FOREIGN PATENT DOCUMENTS

| | | | |
|---|---|---|---|
| DE | 4419290 | A1 | 12/1995 |
| EP | 0841285 | A1 | 5/1998 |

(Continued)

*Primary Examiner* — Anthony Salata
(74) *Attorney, Agent, or Firm* — Fraser Clemens Martin & Miller LLC; William J. Clemens

(57) ABSTRACT

An elevator car for an elevator system includes a car door, a car door mechanism, at least one car door panel, a door drive motor, and a drive control device for the door drive motor. The car door mechanism thereby supports the car door panel. The drive control device includes an operator module having an operator panel, wherein the operator module is disposed on the elevator car so that the operator panel can be operated from the roof of the elevator car and through an opened shaft door from a building floor.

14 Claims, 3 Drawing Sheets

(56) References Cited

U.S. PATENT DOCUMENTS

| | | | | |
|---|---|---|---|---|
| 2009/0272605 | A1* | 11/2009 | Utsunomiya et al. | 187/316 |
| 2012/0138393 | A1* | 6/2012 | Utsunomiya | 187/317 |
| 2012/0168259 | A1* | 7/2012 | Christen | 187/316 |

FOREIGN PATENT DOCUMENTS

| | | | |
|---|---|---|---|
| EP | 1661842 | A1 | 5/2006 |
| WO | 2007020326 | A1 | 2/2007 |

* cited by examiner

DRIVE REGULATING DEVICE ARRANGED AT ELEVATOR CAR DOOR LINTEL

FIELD

The invention relates to an elevator car with a car door and a car door lintel, which carries a car door leaf, wherein a door drive motor and a drive regulating device for the door drive motor are present for moving the car door panel. The invention also relates to an elevator installation with such an elevator car.

BACKGROUND

A method of regulating the opening and closing process of an elevator sliding door and an apparatus for performance thereof are known from DE 44 19 290 A1. In the known method for regulating the opening and closing process of the elevator sliding door the speed away of the door is regulated, wherein the operational state of the drive motor is constantly monitored by a microcontroller. A microcontroller unit in that case comprises apparatus for regulation by the microcontroller. Moreover, buttons are provided which serve for terminating a service operation or for triggering a measurement travel.

In the method known from DE 44 19 290 A1 and the apparatus used for performance thereof the microcontroller unit is poorly accessible. In particular, actuation of the mentioned buttons from the positions, which are usual for maintenance or repair of the door drive, of the maintenance person is hardly possible.

SUMMARY

An object of the invention is to create an elevator car in which the operability of a drive regulating device for a car door is improved, and to propose an elevator installation with such an elevator car. Specifically, it is an object of the invention to create an elevator car in which the operability of a drive regulating device for a door drive motor is improved in the manner that the control elements thereof are better accessible for installation and maintenance operations.

The fulfillment of these objects consists particularly in that in the case of an elevator car with a car door, at least one car door lintel, at least one car door panel, at least one door drive motor and at least one drive regulating device for the door drive motor, a module of the drive regulating device is constructed as a control module and comprises a control panel, wherein the control module is so arranged at the elevator car that the control panel is conveniently operable and in a given case readable on the one hand from the roof of the elevator car and on the other hand via an open shaft door from a building floor.

By "control module" there is to be understood in that case any kind of device which at least makes it possible to manually input control commands at the drive regulating device for the door drive motor.

In an advantageous form of embodiment of the invention the control panel is arranged in the immediate vicinity of an upper side of the car door lintel. It is thereby achieved that the control panel is operable and/or readable on the one hand from the roof of the elevator car and on the other hand—via an open shaft door—from a building floor in simple manner. For operating or reading the control panel from the building floor the elevator car is brought by manual control of the elevator drive into a position which is lowered relative to the floor and in which the upper side of the door lintel and thus the said control panel are located at a height conveniently accessible from the floor.

It is advantageous if the car door lintel has in the region of its upper side a substantially horizontally extending strip and if the control module of the drive regulating device is so fixed to the car door lintel that the control panel of the control module of the drive regulating device is arranged above this strip in a substantially horizontally extending plane. The proposed arrangement of the control panel of the control module of the drive regulating device can be realized simply and economically, since the control module with the control panel is fixable by simple means, for example by way of a screw connection, glue connection or snap connection, to the strip of the car door lintel.

According to another form of embodiment of the invention the car door lintel comprises at its upper side a substantially horizontally extending strip having a recess, wherein at least the control panel of the control module of the drive regulating device is arranged within this recess of the strip. With such an arrangement of the control panel of the control module it is achieved on the one hand that a maintenance person, as described in the foregoing, can operate or read the control panel in simple manner from the roof of the elevator car and also from a building floor. Through the installation in the recess of the strip or in the region protected by the car door lintel an advantageous protection of the control panel and of the rest of the control module is guaranteed on the other hand. This relates particularly to protection from mechanical damage, for example by the maintenance person himself or herself or by objects which drop down.

In a special form of embodiment of the invention the control panel of the control module is so arranged in the recess of the strip that it is substantially flush with the upper side of the strip or disposed somewhat below the upper side of the strip. The afore-described protection of the control panel from damage can thus be guaranteed by the simplest means.

According to an advantageous form of embodiment of the invention the control panel of the control module is constructed as a film keyboard and comprises at least one cover film, a support plate as well as switching elements and indicating elements. In this manner the control module can be realized economically and in space-saving manner as well as positioned in a flexible manner. Thanks to the cover film the protection of the switching and indicating elements of the control module is further improved. This relates particularly to protection of the switching and indicating elements from dirt and from liquids. Moreover, cleaning of dirt or the like can be carried out in simple manner by wiping the cover film. The cover film can be formed to be transparent or non-transparent and its surface can be provided with graphical symbols or designations for the switching elements or the indicating elements.

According to an advantageous form of embodiment of the invention the support plate of the control panel is fixed directly or by way of an intermediate layer to the strip of the car door lintel. Since this strip is present as a bent-over flange of a U-shaped or Z-shaped car door lintel, the control panel, which is preferably present as a film keyboard, and thus the entire control module of the drive regulating device can be mounted by the simplest means and economically.

According to one of the forms of embodiment of the invention the support plate of the control panel is fixed on the upper side of the horizontal strip of the car door lintel. The simplest and most economic mounting of the control module is realized by this arrangement.

According to another form of embodiment of the invention the support plate of the control panel is fixed on the underside of the horizontal strip of the car door lintel. Together with the arrangement of the control panel within a recess of the strip a particularly well-protected arrangement of the control module or of the control panel of the drive regulating device thus results.

According to a preferred form of embodiment of the invention the control module of the drive regulating device is constructed as a control and indicating module and the drive regulating device comprises a further module which is constructed as a drive module, wherein the drive module is connected with the control and indicating module. In this regard, the drive module is in advantageous manner constructed as a drive and regulating module for the door drive motor. With the division of the drive regulating device into modules, a particularly high level of flexibility with respect to production, logistics and mounting of the drive regulating device is achieved.

Expediently, the control and indicating module is connected with the drive module by means of an interface device which enables free selection of the arrangement of the control and indicating module with respect to the position of the drive module as well as a separate exchange of the control and indicating module. Advantageously, the control and indicating module is connected with the drive module by means of at least one easily separable and connectible interface device, for example by a cable equipped with plug connections. Such an interface device can, however, also be present in the form of a wire-free radio connection which enables communication between the control module and the drive module.

Thanks to such an interface device the control and indicating module can be arranged separately from the drive module at the upper side of the car door lintel, particularly at the upper side of the horizontally extending strip. In general, through the interface device a high level of flexibility with respect to the arrangement of the components or the modules of the drive regulating device results. Moreover, a maintenance-friendly design of the drive regulating device can thereby be achieved. Specifically, in the case of damage or age-induced failure the control and indicating module or the drive module can be separately exchanged. Moreover, a modular construction is thereby made possible in order to combine, with respect to the individual case of use, a suitable control and indicating module with a suitable drive module.

According to an advantageous form of embodiment of the invention the drive module is constructed as a drive and regulating module for driving the door drive motor, wherein the drive module comprises a program memory which obtains from an elevator control only the commands for opening and closing the elevator doors and controls further required movements and reactions of the door drive motor according to a learning travel independently of the elevator control. The combination of the proposed control module with a drive module of that kind yields a door drive control which is particularly simple to install and to maintain.

DESCRIPTION OF THE DRAWINGS

Preferred exemplifying embodiments of the invention are explained in more detail in the following description on the basis of the accompanying drawings, in which the same or equivalent elements are provided with corresponding reference numerals and in which.

DETAILED DESCRIPTION OF THE INVENTION

Figure 1:
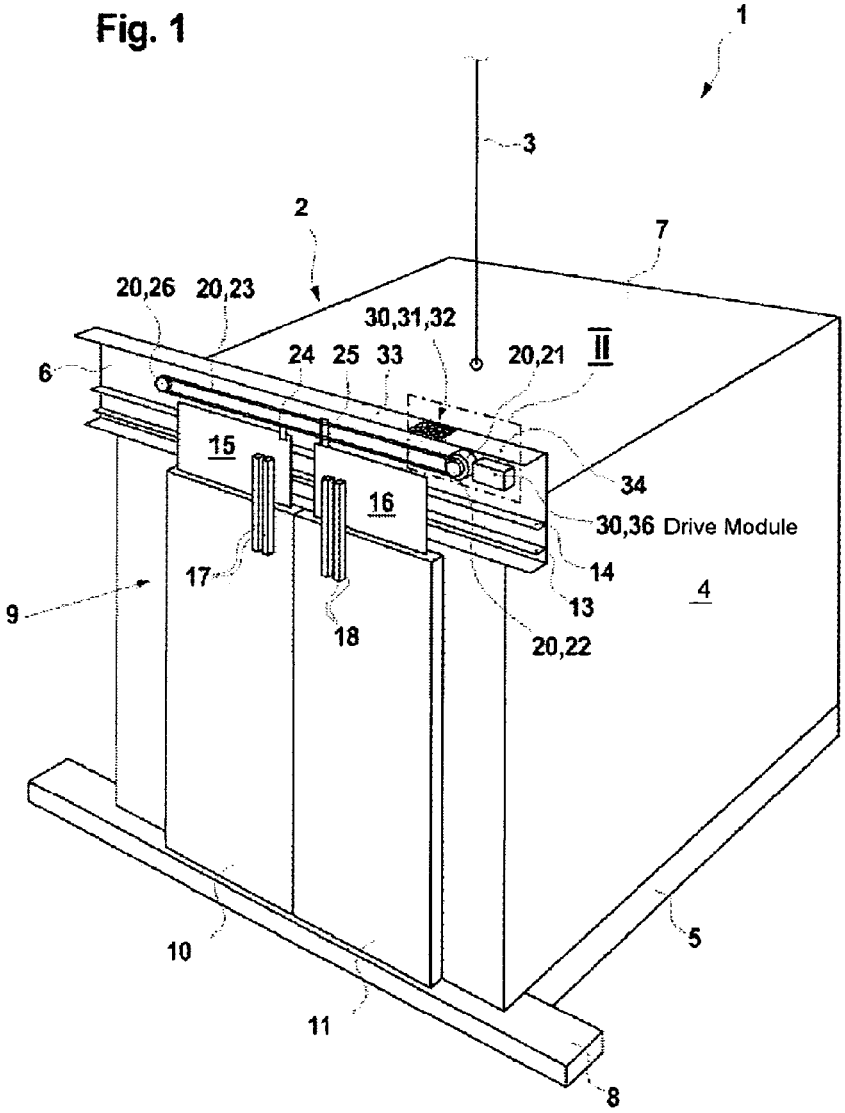
FIG. 1 shows an elevator installation with an elevator car in a schematic perspective illustration with a drive regulating device, which comprises a drive module with a control panel corresponding with the exemplifying embodiments of the invention.

FIG. 1 shows an elevator installation 1 according to the invention in a schematic perspective illustration in the manner of a detail. The elevator installation 1 comprises an elevator car 2 and a schematically illustrated support means 3 connected with the elevator car 2. The elevator car 2 is guided by means of suitable car guide rails (not illustrated) in an elevator shaft (similarly not illustrated). The elevator car 2 comprises a base body 4 arranged on a platform 5. Moreover, a car door lintel 6 is provided, which is connected with the base body 4 of the elevator car 2. In this exemplifying embodiment the car door lintel 6 projects in vertical direction above an upper side 7 of the base body 4. A door threshold 8 is connected with the platform 5.

The elevator car 2 comprises a car door 9. In this exemplifying embodiment the car door 9 has two car door panels 10, 11. The car door panels 10, 11 of the car door 9 are carried and guided to be horizontally displaceable by the car door lintel 6. Moreover, the car door panels 10, 11 can also be guided at the door threshold 8.

The car door lintel 6 comprises guide rails 13, 14 with which guide elements 15, 16 are associated. The guide elements 15, 16 are guided at the guide rails 13, 14 by way of, for example, rollers or the like. The guide elements 15, 16 are connected with the car door panels 10, 11 by way of connecting elements. The car door panels 10, 11 of the car door 9 are thereby suspended and guided to be horizontally displaceable at the guide rails 13, 14 of the car door lintel 6 by way of the guide elements 15, 16. Coupling elements are represented by 17 and 18, which on opening or closing of the car door panels couple with respectively corresponding shaft door panels.

The car door of the elevator car 2 comprises a door drive 20 which in this exemplifying embodiment comprises a door drive motor 21 with a door drive pulley 22, a deflecting roller 26 and a traction means 23. The traction means 23 is in that case guided on the one hand around the drive pulley 22 of the door drive motor 21 and on the other hand around the deflecting roller 26. The door drive motor 21 can be operated with alternating rotational direction and with variable speed. The guide element 15 is connected with the traction means 23 by way of a connecting element 24. Moreover, the guide element 16 is connected with the traction means 23 by way of a connecting element 25. In this regard, the guide elements 15, 16 of the two car door panels 10, 11 are so connected with the traction means 23 by way of the connecting elements 24, 25 that on actuation of the door drive motor 21 an opening or closing of the car door 9 takes place in dependence on the rotational direction. The car door panels 10, 11 in that case execute mutually opposite horizontal movements.

The elevator installation 1 comprises a drive regulating device 30 which serves the purpose of controlling the movement of the door drive motor 21 in dependence on control commands of an elevator control at regulable rotational speed. The drive regulating device 30 comprises at least one control module 31 as well as a drive module 36. The drive module 36 is constructed as, in particular, a drive and regulating module. The drive module 36 preferably comprises a frequency converter or a direct current regulator. The drive module is advantageously constructed as a drive and regulating module for driving the door drive motor, wherein the drive module comprises a program memory which after a learning travel controls the required movements and reactions of the door drive motor 21 exclusively on the basis of two commands of an elevator control for opening and closing the car door 9. Such controlled movements and reactions are, for example, controlled acceleration or deceleration processes in normal operation, force limitation, rapid stop and reversing travel when an obstacle is recognized, repeated attempts at closing if an obstacle exists over a certain time period and learning travel at reduced speed for recognition of the travel distances and path limitations of the door panel. The combination of the proposed control module with a drive module of that kind results in a door drive control which is particularly simple to install and to maintain.

The control module 31 of the drive regulating device 30 has a control panel 32 which makes it possible to transmit certain commands and data to the drive module 36 by means of a keyboard as well as to read off optically or acoustically signalled status data of the drive module. The control panel 32 of the control module 31 is arranged in the region of an upper side 33 of the car door lintel 6. As a result, on the one hand it is readily accessible from the upper side 7 of the base body 4 of the elevator car 2, i.e. from the roof of the elevator car. On the other hand, it is also conveniently accessible and operable from a building floor when the associated shaft door was opened and the elevator car lowered relative to the associated floor level by approximately a meter, which corresponds with a usual situation in the maintenance of the car door 9. For this purpose the control module 31 together with the control panel 32 is also so positioned laterally that it is operable or readable via the shaft door opening.

The control module 31 of the drive regulating device 30 is connected with the drive module 36 of the drive regulating device 30 by way of an interface device, which is not shown in FIG. 1. By way of the control panel 32 a maintenance person can, for example, read off status reports of the entire drive regulating device, undertake adjustments of the drive module 36 or at end positions of the door panels, perform a function check of the door drive or initiate a learning cycle for the door drive.

Figure 2:
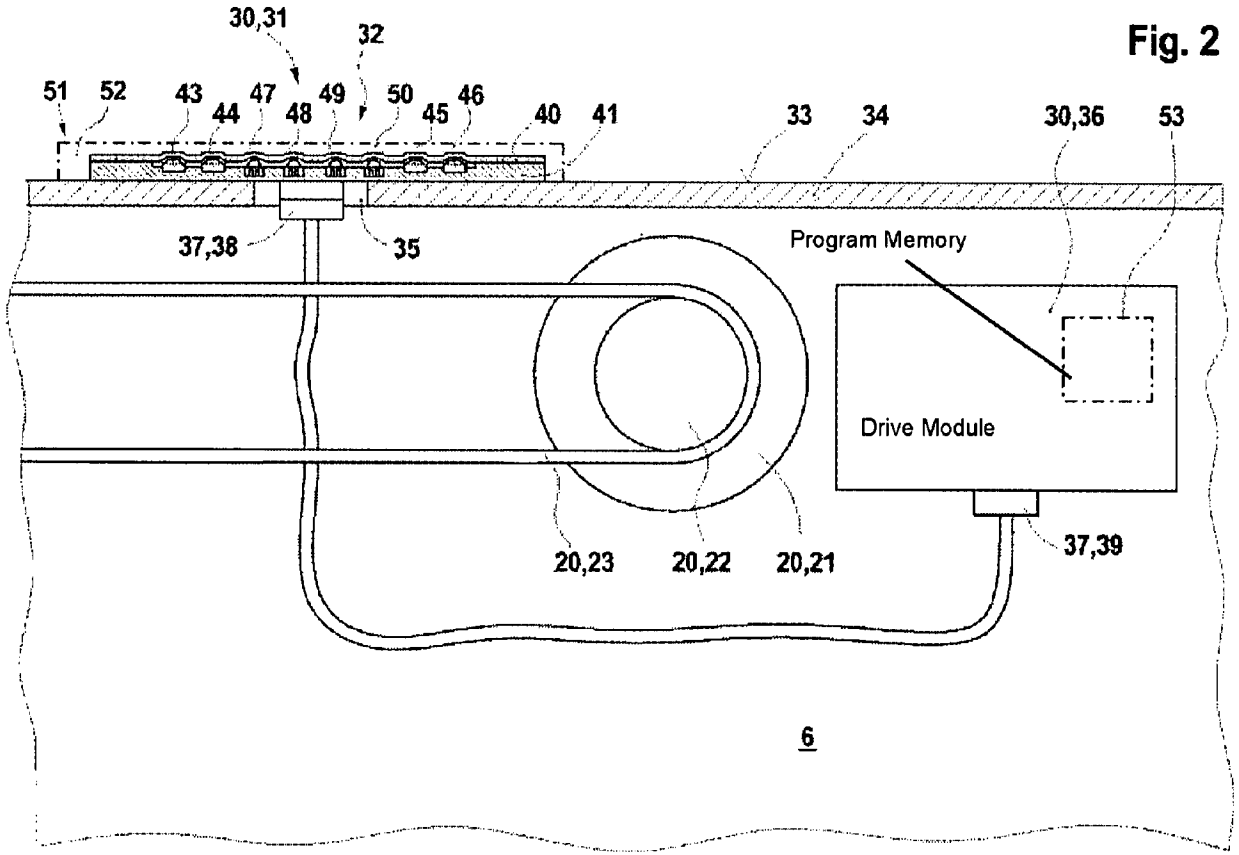
FIG. 2 shows the detail, which is denoted in FIG. 1 by II, of an elevator car in a schematic illustration in correspondence with the first exemplifying embodiment of the invention.

FIG. 2 shows the detail, which is denoted in FIG. 1 by II, of an elevator car of an elevator installation in correspondence with a first exemplifying embodiment in a schematic sectional illustration in the manner of a detail. In this exemplifying embodiment the drive regulating device 30 comprises two modules 31, 36. The control module 31 is in this regard constructed as a control and indicating module with a control panel 32. The drive module 36 is preferably constructed as a drive and regulating module and includes the already mentioned program memory 53, which obtains from an elevator control only the commands for opening and closing the elevator doors and by way of the drive module 36 controls the further required movements and reactions of the door drive motor independently of the elevator control. The car door lintel 6 has in the region of its upper side 33 a strip 34 extending substantially horizontally. This strip 34 is formed by a flange of the U-shaped car door lintel 6. Fixed on the upper side 33 of the strip 34, which upper side 33 is identical with the upper side 33 of the car door lintel 6, is the control module 31, which comprises the control panel 32, of the drive regulating device 30. The control module 31 comprises a support plate 41 and a cover film 40, wherein the cover film 40 forms a control panel of a film keyboard. The cover film 40 is connected with the support plate 41 by, for example, gluing. Embedded between support plate 41 and cover film 40 are switching elements 43, 44, 45, 46 which can be actuated by finger pressure on the respectively corresponding location of the cover film in order to generate specific control signals. Moreover, embedded between support plate 41 and cover film 40 are indicating elements 47, 48, 49, 50 which serve the purpose, in particular, of indicated status signals or disturbance data which, in particular, are generated by the drive module 36 of the drive regulating device 30. The cover film 40 covers not only the switching elements 43 to 46, but also the indicating elements 47 to 50, so that these are protected by the cover film 40 from mechanical damage, dirt, liquids or the like. The cover film 40 can be transparent or non-transparent in the region of the control panel and have graphical symbols or designations which characterize the position or the significance of the switching elements or the indicating elements.

The control module 31 is fixed on the strip 34 of the car door lintel 6 in that the support plate 41 of the control module is fastened to the upper side 33 of the said strip 34, for example by means of a screw, plug, snap or glue connection.

The control module 31 can be fixed on the said strip 34 in a protective section 51 bent to be U-shaped (variant illustrated by dot-dashed lines). The control module in this case lies on a horizontally arranged web (not visible here) of the U-shaped protective section 51 and the vertical limb 52 of the protective section 51 protects the control module from damage by objects dropping down or by the shoes of a maintenance person standing on the cage door lintel 6.

The control module 31 is connected with the drive module 36 by way of an interface device 37, for example by way of an interface cable. The interface device 37 comprises parts 38, 39 which, for example, can be constructed as parts of plug connections. The control module 31 and the drive module 36 can thus be separated from one another in that one of the plug connections, which comprises the parts 38, 39, of the interface device 37 is separated. A separate exchange of the control module 31 and the drive module 36 is possible through such an interface device. Specifically, in the case of failure or in the case of damage the control module 31 can be exchanged in simple manner, for example within the scope of maintenance.

This is because where the control module 31 is fastened to the afore-mentioned strip 34 of the car door lintel 6, the strip 34 has a recess 35 which in this form of embodiment serves the purpose of receiving a part of the control module 31, here the plug connection 38 of a cable of the interface device 37.

Figure 3:
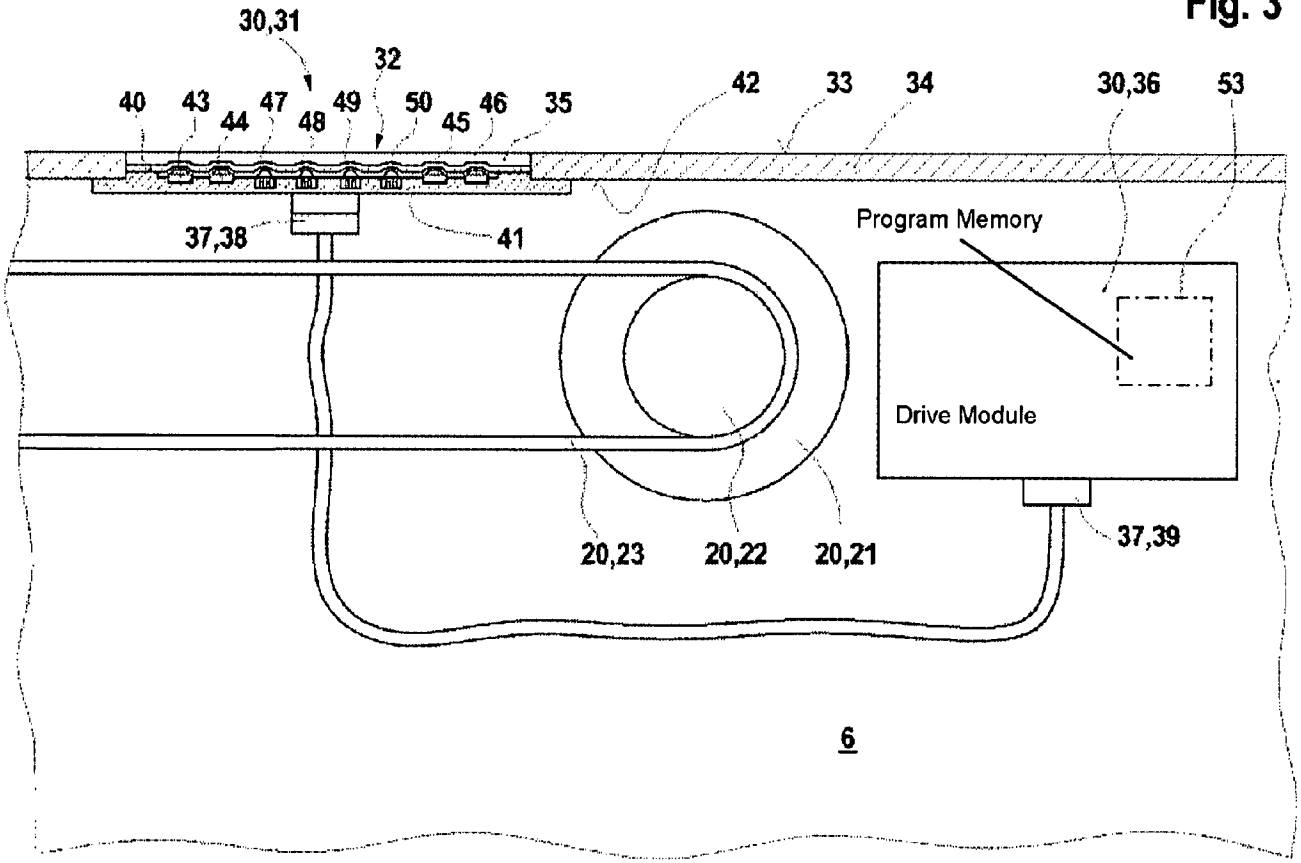
FIG. 3 shows the detail, which is denoted in FIG. 1 by II, of an elevator car in a schematic illustration in correspondence with a second exemplifying embodiment of the invention.

FIG. 3 shows the detail, which is denoted in FIG. 1 by II, of an elevator car of an elevator installation in correspondence with a second exemplifying embodiment in a schematic sectional illustration in the manner of a detail. Components which are the same as or equivalent to those already illustrated in FIG. 2 are characterized in FIG. 3 by the same reference numerals. In this exemplifying embodiment the drive regulating device 30 also comprises a drive module 36 and a control module 31, wherein the control module 31 is constructed as a control and indicating module with a control panel 32. The drive module 36 is again preferably constructed as a drive and regulating module. In this second exemplifying embodiment the strip 34 of the door car lintel 6 has a recess 35 in which at least the control panel 32 of the control module 31 is arranged. In upward direction the control panel 32 is either flush with the upper side 33 of the strip 34 or it is arranged somewhat below this upper side 33. The support plate 41 in this exemplifying embodiment is fastened to the underside 42 of the strip 34. The form of embodiment according to a second exemplifying embodiment has the advantage that the control module 32 is particularly well protected against damage. Such damage can arise, for example, due to objects being placed thereon or a person with shoes walking thereon during mounting of the elevator installation or during execution and maintenance operations.

The invention is not restricted to the described exemplifying embodiments. For example, an elevator car according to the invention can be equipped with a car door which comprises only one door panel or comprises more than two door panels. It is also possible within the scope of the invention for the drive module to be so arranged that the drive module forms a physical unit with the control module comprising the control panel or at least adjoins the control module. The interface unit serving as connection between the control module and the drive module can also be present, for example, in the form of a bus connection.

In accordance with the provisions of the patent statutes, the present invention has been described in what is considered to represent its preferred embodiment. However, it should be noted that the invention can be practiced otherwise than as specifically illustrated and described without departing from its spirit or scope.

The invention claimed is:

1. An elevator car with a car door, a car door lintel, at least one car door panel, a door drive motor and a drive regulating device for the door drive motor, wherein the car door lintel carries the at least one car door panel and wherein a module of the drive regulating device is arranged at the car door lintel, comprising:

the module of the drive regulating device being a control module; and said control module having a control panel, wherein said control module is arranged at an upper side of the car door lintel for access and operation of said control panel from a roof of the elevator car and from an adjacent building floor through an opened shaft door.

2. The elevator car according to claim 1 wherein the car door lintel includes a horizontally extending strip forming said upper side and said control module of the drive regulating device is attached to the car door lintel to arrange said control panel horizontally above said strip.

3. The elevator car according to claim 1 wherein the car door lintel includes a horizontally extending strip forming said upper side, said strip having a recess and said control panel of the control module being arranged within said recess of said strip.

4. The elevator car according to claim 3 wherein said control panel of the control module is flush with said upper side or arranged below said upper side.

5. The elevator car according to claim 1 wherein said control panel of the control module is constructed as a film keyboard and comprises a cover film, a support plate connected to said cover film, and a plurality of switching elements and indicating elements positioned between said cover film and said support plate.

6. The elevator car according to claim 5 wherein said support plate of said control panel is fixed to a strip forming said upper side of the car door lintel.

7. The elevator car according to claim 6 wherein said support plate of said control panel is fixed on an upper side of said strip.

8. The elevator car according to claim 6 wherein said support plate of said control panel is fixed to an underside of said strip.

9. The elevator car according to claim 1 wherein said control module of the drive regulating device is a control and indicating module and the drive regulating device includes a further module which is a drive module, wherein said drive module is electrically connected with said control and indicating module.

10. The elevator car according to claim 9 wherein said control and indicating module is connected with said drive module by an interface device enabling a separate exchange of said control and indicating module.

11. The elevator car according to claim 9 wherein said drive module is a drive and regulating module for driving the door drive motor and includes a program memory which after a learning travel of the car door, controls by said drive module required movements and reactions of the door drive motor in response to commands of an elevator control for opening and closing the car door.

12. An elevator installation including an elevator car according to claim 1.

13. An elevator car with a car door, a car door lintel, at least one car door panel, a door drive motor and a drive regulating device for the door drive motor, wherein the car door lintel carries the at least one car door panel, comprising:

the drive regulating device having a control module being arranged at an upper side of the car door lintel;

said control module having a control panel being arranged at the car door lintel for access and operation of said control panel from a roof of the elevator car and from an adjacent building floor through an opened shaft door; and said control panel being constructed as a film keyboard having a cover film, a support plate connected to said cover film, and a plurality of switching elements and indicating elements positioned between said cover film and said support plate.

14. An elevator car with a car door, a car door lintel, at least one car door panel, a door drive motor and a drive regulating device for the door drive motor, wherein the car door lintel carries the at least one car door panel and wherein a module of the drive regulating device is arranged at the car door lintel, comprising:

the module of the drive regulating device being a control module; and said control module having a control panel, wherein said control module is arranged at an upper side of the car door lintel for access and operation of said control panel from a roof of the elevator car and from an adjacent building floor through an opened shaft door;

wherein the car door lintel includes a horizontally extending strip forming said upper side and said control module of the drive regulating device is attached to the car door lintel to arrange said control panel horizontally above said strip.

* * * * *